US008931837B2

(12) United States Patent
Vernon

(10) Patent No.: US 8,931,837 B2
(45) Date of Patent: Jan. 13, 2015

(54) THORACIC BACK SUPPORT

(76) Inventor: Danielle Vernon, Austin, TX (US)

( * ) Notice: Subject to any disclaimer, the term of this patent is extended or adjusted under 35 U.S.C. 154(b) by 546 days.

(21) Appl. No.: 13/099,621

(22) Filed: May 3, 2011

(65) Prior Publication Data

US 2012/0280545 A1 Nov. 8, 2012

(51) Int. Cl.

| | |
|---|---|
| ***A47C 7/02*** | (2006.01) |
| ***B23P 11/00*** | (2006.01) |
| ***A47C 7/42*** | (2006.01) |
| ***A47C 7/46*** | (2006.01) |

(52) U.S. Cl.

CPC .. *A47C 7/425* (2013.01); *A47C 7/46* (2013.01)
USPC ..... 297/230.1; 297/284.5; 297/452.32; 297/452.37

(58) Field of Classification Search

USPC ..... 297/452.32, 452.37, 452.29, 230.1, 297/284.5; 5/653
See application file for complete search history.

(56) References Cited

U.S. PATENT DOCUMENTS

| | | | | | |
|---|---|---|---|---|---|
| 2,056,767 | A | * | 10/1936 | Blath | 128/889 |
| 3,145,054 | A | * | 8/1964 | Sopko, Jr. | 297/452.3 |
| 3,713,696 | A | * | 1/1973 | Dudley | 297/452.55 |
| 4,189,182 | A | * | 2/1980 | Rhoe | 297/452.32 |
| 4,424,599 | A | * | 1/1984 | Hannouche | 5/632 |
| 4,572,578 | A | * | 2/1986 | Perkins | 297/452.32 |
| 4,597,386 | A | * | 7/1986 | Goldstein | 602/19 |
| 4,819,278 | A | * | 4/1989 | Ramos | 4/254 |
| 4,928,335 | A | * | 5/1990 | Pedrow | 5/648 |
| D310,312 | S | * | 9/1990 | Wong et al. | D6/596 |
| 5,033,137 | A | * | 7/1991 | Pedrow | 5/636 |
| 5,039,158 | A | * | 8/1991 | Maier | 297/452.37 |
| 5,344,211 | A | * | 9/1994 | Adat et al. | 297/230.14 |
| 5,457,832 | A | * | 10/1995 | Tatum | 5/636 |
| 5,547,251 | A | * | 8/1996 | Axelson | 297/284.5 |
| 6,036,719 | A | * | 3/2000 | Meilus | 606/204 |
| 6,299,248 | B1 | * | 10/2001 | Gennaro et al. | 297/230.13 |
| 6,969,114 | B2 | * | 11/2005 | Keilhauer | 297/230.1 |
| 8,434,492 | B2 | * | 5/2013 | Jones | 128/845 |
| 8,496,007 | B2 | * | 7/2013 | Rambo et al. | 128/845 |

FOREIGN PATENT DOCUMENTS

| | | | | | |
|---|---|---|---|---|---|
| EP | 109258 | A2 | * | 5/1984 | A47C 7/42 |
| GB | 2155781 | A | * | 10/1985 | A47C 7/40 |

OTHER PUBLICATIONS

Joint Industry Foam Standards and Guidelines, Indentation Force Deflection (IFD) Standards and Guidelines, Jul. 1994, Polyurethane Foam Association, Section 4.2.2.*

(Continued)

*Primary Examiner* — David R Dunn
*Assistant Examiner* — Tania Abraham
(74) *Attorney, Agent, or Firm* — Meyertons, Hood, Kivlin, Kowert & Goetzel, P.C.; Eric B. Meyertons

(57) ABSTRACT

A thoracic back support sits vertically against the back portion of a chair/seat in which a force is transmitted through the thoracic area of the spine of a user. The thoracic back support has an interior resilient substrate that is divided by a shallow groove that extends from the lower cervical spine to the upper lumbar spine. The groove helps to reduce any stress over the spinous processes as the individual leans back against the thoracic back support. When the resilient substrate is compressed, a force is primarily directed into the soft tissue areas adjacent to the spine which allows for the thoracic spine to move into a maximally neutral position.

17 Claims, 5 Drawing Sheets

(56) References Cited

OTHER PUBLICATIONS

Hibak Rest Lumbar Back Support Pillow, Pain-Relief.com website, Jan. 11, 2011.

Hourglass Cervical Rest Pillows—Mabis, Pain-Relief.com website, Jan. 11, 2011.

Back Buddy Products, OrthopaedicIndia.com website, Jan. 11, 2011.

Satin Caress Neck Support, Maxiaids.com website, Jan. 11 2011.

* cited by examiner

THORACIC BACK SUPPORT

BACKGROUND OF THE INVENTION

1. Field of the Invention

The invention generally relates to back supports. More particularly the invention relates to back support that provide thoracic back support.

2. Description of the Relevant Art

Many people suffer from varying degrees of neck, shoulder and back pain. The stress and micro-traumas imposed by the constant motion of the cervical spine, and at times the awkward positions of the neck for prolonged periods of time, all take their toll on the cervical disks. The area of the spine from which all these other joints move around is called the thoracic spine. Its 12 thoracic vertebra are the stiffest joint segments of the spine, have the poorest blood circulation due to their attachment to the rib cage and maintain the role as the anchor from which the much more unstable cervical and lumbar segments stabilize themselves.

Most low back, neck and shoulder injuries are a result of repetitive stressors, poor and prolonged postural positions and a more sedentary lifestyle which leads to soft tissue and neurological injuries that may require rest of some sort of therapy and anti-inflammatory drugs. With constant repetitive stressors and poor postural positions, nerve and tendon impingement can progress requiring steroid injection, loss of sensory and motor control and, ultimately, surgical procedures that may or may not have a positive outcome.

A common source of relief can include bracing or lumbar cushions that cause further kyphotic positioning of the thoracic spine leading to greater cervical protraction and decreased lumbar lordosis. These positions make the spine more susceptible to pressure and vibration. Many back supports on the market tend to push the entire upper back forward to improve upright positioning but don't allow for scapular retraction so the body is more upright but continues to be positioned in a rounded, shoulders forward, neck sticking out posture. Only when the scapula is allowed to retract and the sternum is pushed forward, can the rest of the spine return to its natural, healthy alignment. Unfortunately, if a brace is worn for too long, the person can become dependent on it and the muscles around the spine can atrophy further and the time for recovery can be delayed. In addition, lumbar rolls can place the lumbar spine in a more rounded position but, when the individual is trying to work at a surface in front of them such as a desk or steering wheel, the lumbar extension can cause the individual to have to reach further to the object in front of them thereby creating more thoracic kyphosis (poor slumped posture) and greater malalignment of the spine. This, in turn, results in compression of certain soft tissues and joints, distraction of the other side of the joint with subsequent muscle lengthening and atrophy as well as neurological compromise around the neck and shoulders where these nerves need to exit their bony tunnels.

It is well known to provide pillows or cushions to make chairs more comfortable. Cushions that the individual can sit on are beneficial when vibration issues are a concern but often the individual still has to have a good chair in which this is placed upon and there is little or no control as to how the individual sits while on this cushion.

It is desirable to have a back support that supports that thoracic region while allowing retraction of the shoulder blades.

SUMMARY OF THE INVENTION

In one embodiment, a thoracic back support for a user sitting in a seat includes a resilient substrate, wherein a groove is formed along the longitudinal axis of the resilient substrate, wherein the groove comprises a shape that is capable of receiving the spinous processes of the user. The resilient substrate includes a top portion, a central portion, and a bottom portion, wherein the top portion has a width greater than the width of the central portion. The resilient substrate may be formed from a foam material having an indentation force deflection of less than about 30. In an embodiment, the resilient substrate comprises a first resilient material and a second resilient material, wherein the first resilient material has an indentation force deflection that is less than the indentation force deflection of the second resilient material, and wherein the groove is formed in the first resilient material.

In one embodiment, the substrate has an arcuate tapered shape extending from the top portion to the center portion. The tapered portion of the substrate is shaped such that the scapulas of the user are substantially unsupported by the substrate during use. In an embodiment, the bottom portion has a width greater than the width of the central portion. The substrate may have an arcuate tapered shape extending from the top portion to the center portion and an arcuate tapered shape extending from the bottom portion to the center portion.

The substrate, in some embodiments, has a longitudinal length such that the upper portion provides support for the thoracic region of the user and the lower portion provides support for the lumbar region of the user.

The thoracic back support may include a coupling device coupled to the resilient substrate, wherein the coupling device, during use, couples the resilient substrate to the seat. In some embodiments, a thoracic back support includes a cover surrounding at least a portion of the substrate.

In an embodiment a method of providing thoracic back support to a user sitting in a seat, includes coupling a thoracic back support to a seat, the thoracic back support including a resilient substrate, wherein a groove is formed along the longitudinal axis of the resilient substrate, wherein the groove comprises a shape that is capable of receiving the spinous processes of the user. The resilient substrate comprises a top portion, a central portion, and a bottom portion, wherein the top portion has a width greater than the central portion. The method also includes aligning the thoracic back support with the user such that the spinous processes of the user are substantially aligned with the groove, the thoracic region of the user is aligned with the upper portion of the thoracic back support.

BRIEF DESCRIPTION OF THE DRAWINGS

Advantages of the present invention will become apparent to those skilled in the art with the benefit of the following detailed description of embodiments and upon reference to the accompanying drawings in which.

Figure 1:
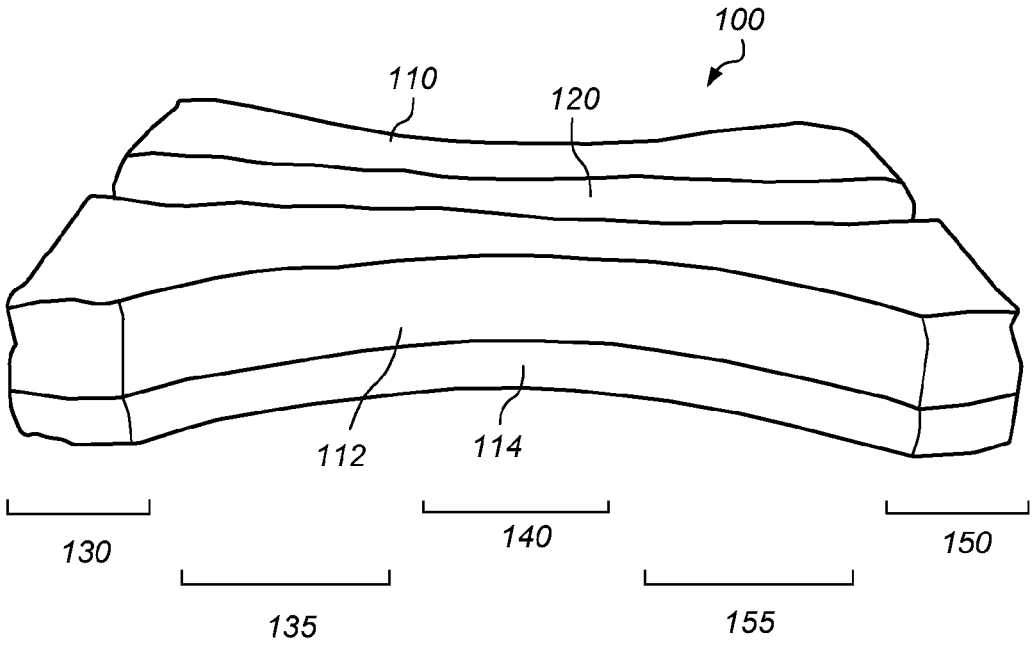
FIG. 1 depicts a side view of an embodiment of a thoracic back support.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

It is to be understood the present invention is not limited to particular devices or methods, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected.

The human spine is generally divided into four sections: the cervical region extending from the neck to the skull; the thoracic region extending through the upper back; the lumbar region extending through the lower back; and the sacral region is the base of the spine and connects the spine to the pelvic bones. Embodiments described herein relate to a back support that engages the thoracic region of an individual.

Figure 2:
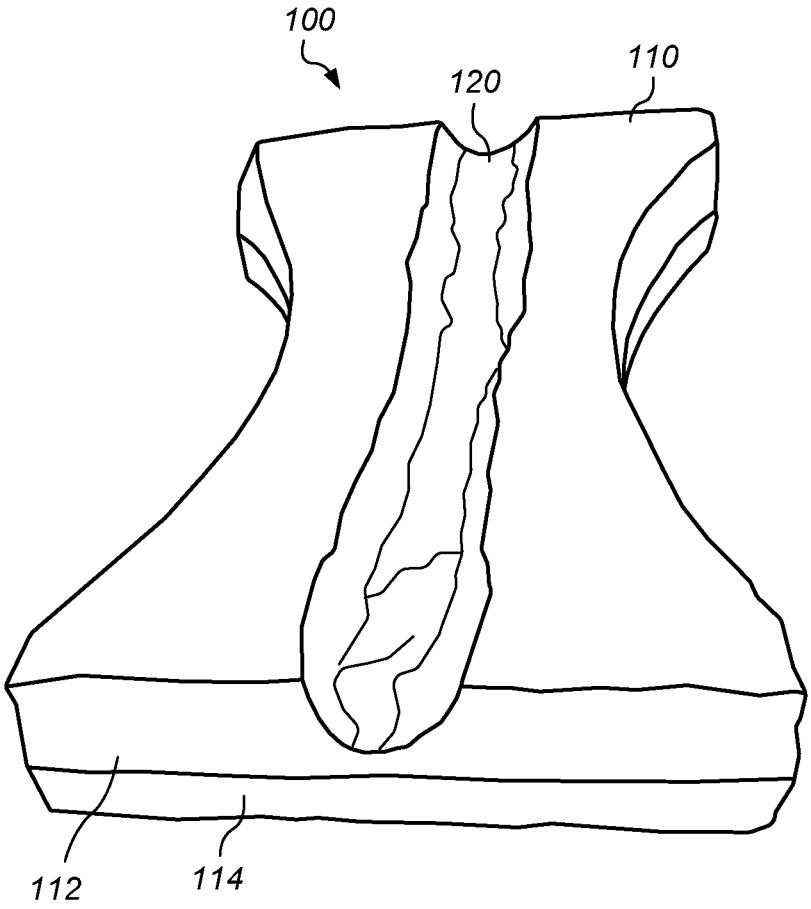
FIG. 2 depicts a perspective view of the thoracic back support of FIG. 1

An embodiment of a thoracic back support is depicted in FIGS. 1 and 2. A thoracic back support 100 includes a resilient substrate 110. As used herein the term "resilient" is used to describe a material that is capable of regaining its original shape or position after bending, stretching, compression, or other deformation. Resilient substrate 110 includes a groove 120 formed along the longitudinal axis of the resilient substrate. The resilient substrate includes a top portion 130, a central portion 140 and a bottom portion 150. In an embodiment, top portion 130 has a width that is greater than the width of central portion 140. When positioned to support a user, the thoracic back support is positioned such that the support extends from the lower cervical region to the upper lumbar region. Groove 120 has a shape that is capable of receiving the spinous processes of the user. Thus, when used, the spinous process of the user rests in groove 120, while the thoracic region of the user is supported by the resilient substrate. Groove 120 reduces stresses on the spinous process of the user, when the user leans back on the thopracic back support.

In one embodiment, the thoracic back support includes an arcuate tapered section 135 extending from top portion 130 to central portion 140. The tapered portion is shaped such that the scapula (shoulder blades) of the user are substantially unsupported by the resilient substrate, allowing the scapula to retract to a more normal position when a user is using the back support. In some embodiments, the central portion is approximately 3-5" wide and spans to either side of the thoracic spine to provide enough support on the paraspinals, but does not extend beyond the rib angles.

The thoracic back support depicted in FIGS. 1 and 2 has an hourglass structure that has a cut out (e.g., the arcuate tapered upper portion) for the shoulder blades, allowing most of the postural force to be placed through the thoracic region, allowing the sternum to come forward. This creates a natural relaxation of the shoulders back which naturally allows the neck to sit directly on top of the shoulders. This helps to reduce anterior-posterior muscle imbalances along the neck, chest, shoulders and back. The thoracic support may have a larger, more bulbous section of material to support the lower cervical areas with the center groove aligned over the spinous processes, beginning at the lower cervical segments and ending at the upper lumbar segments. The thoracic support may be located between the individual and a seat (such as a chair or driver's seat of an automobile, truck or bus) that will cause compression of the resilient substrate to create a force that is primarily directed into the paraspinal soft tissue areas along the thoracic spine, between the shoulder blades to assist in attaining the desired neutral posture of the thoracic spine and subsequent lumbar lordosis as well as scapular retraction.

In an embodiment, the bottom portion of the thoracic back support has a width that is greater than the width of the central portion. the thoracic back support includes an arcuate tapered section 155 extending from bottom portion 150 to central portion 140. The tapered portion is shaped to provide support to the lumbar region of the user. In some embodiments, a thoracic back support includes both arcuate tapered section 135 and arcuate tapered section 155, as depicted in FIGS. 1 and 2.

While FIGS. 1 and 2 depict an embodiment that includes two tapered sections, an alternate embodiment of a thoracic back support may only include the upper tapered section 135, while the lower section remains substantially untapered (e.g., having a width about the same as the central region).

In the embodiments depicted in FIGS. 1 and 2 the thoracic back support provides support for both the thoracic region and the lumbar region of the user. In order to provide support for different size users, the thoracic back support may be designed having a variety of lengths. The appropriate length for the user may be determined my measuring the distance from the lower cervical vertebrae (e.g., C6-C7) to the upper lumbar vertebrae (T12-L1). Alternatively, the size of the thoracic back support may be altered by changing the length of the upper portion and/or bottom portion. Additionally, the thoracic back support's width and depth may be adjusted to maximally suit the size of the user and the surface to which it will be attached.

The thoracic back support is composed of a resilient material. In one embodiment, the resilient material is foam material. As used herein the term "foam" refers to a material that is formed by trapping gaseous bubbles in a solid. Generally any type of resilient foam may be used. Resilient foams include open celled foams, closed cell foams, and dual density foam. Closed cell foams include foams such as polyethylene foams, polystyrene foams, and neoprene foams. Open celled foams include foams such as polyester foams, polyurethane foams, polyether polyurethane foams, polyimide foams, and visco-elastic polyurethane foams. Gel materials may also be used as the resilient substrate.

Resilient foam materials may be characterized by their indentation force deflection ("IFD"). IFD is defined, in ASTM D 3574, as the amount of force, in pounds, required to indent a fifty square inch, round indentor foot into a predefined foam specimen a certain percentage of the specimen's total thickness. In one embodiment, the IFD of the resilient material (as determined as the number of pounds/50 insq. to cause a 25% deflection on a four inch thick piece of foam) should be less than 30 pounds. As the IFD of the foam material is lowered, the resiliency increases allowing the foam material to become more easily indented.

Figure 3:
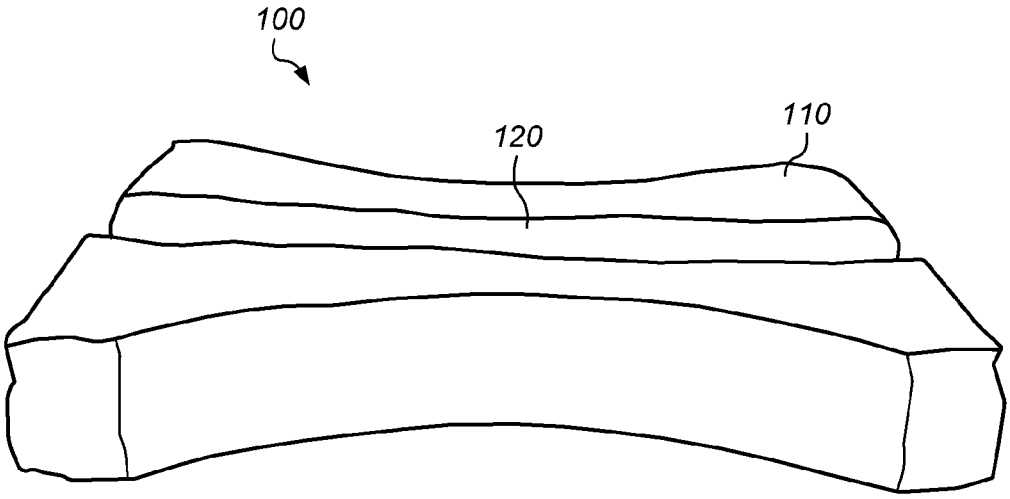
FIG. 3 depicts a side view of an alternate embodiment of a thoracic back support.

In one embodiment, the resilient substrate 110 comprises a first resilient material 112 and a second resilient material 114. First resilient material 112 has an IFD that is less than the IFD of second resilient material 114. In this manner the second resilient material provides a firm support the thoracic region of the back, while the first resilient material allows greater resiliency to provide a softer support for the spinous processes of the user. It should be understood that while two resilient materials are depicted in FIGS. 1 and 2, a thoracic back support may be formed from a single resilient material, as depicted in FIG. 3.

Figure 4:
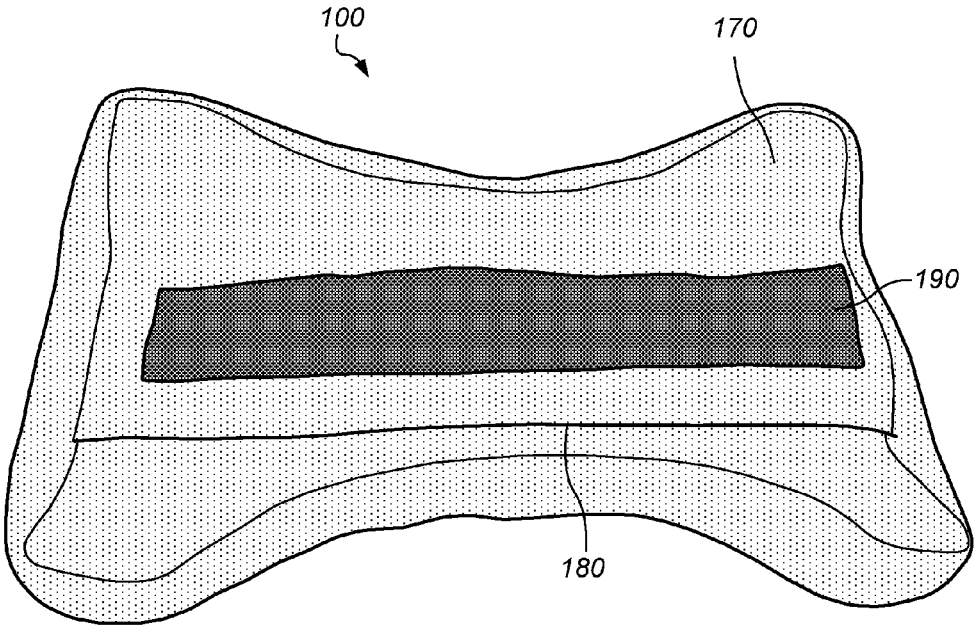
FIG. 4 depicts a perspective view of a covered thoracic back support.

To protect the resilient substrate, a cover may be placed over the resilient substrate. FIG. 4 depicts a cover 170 that at least partially surrounds a resilient substrate. Cover may include a slot 180 that may be used to insert the resilient substrate into the cover. Slot 180 may include a sealing portion (not shown) that inhibits opening of the slot. For example, a hook and loop fastening system (e.g., a Velcro® strip) may be used to keep the slot closed. Cover 170 may include a coupling device 190. Coupling device 190, in one embodiment, may be a portion of a hook and loop fastening system. For example, coupling device 190 may be a hook portion of a hook and loop fastening system. The hook portion of a hook and loop fastening system may couple to the fabric, adhering the thoracic back support to the seat. Cover 170 may be formed from a variety of fabric materials, including, but not limited to cotton cloths, polyfibers, upholstery materials, corduroy, etc. Cover 170 may be created to from a material that is washable. Waterproof covers may be created in order for users to use the thoracic back support in water environments such as hot tubs, boats, bath tubs etc. The thoracic back support cover may be produced in a variety of colors to match the surfaces to which it is being attached.

Figure 5:
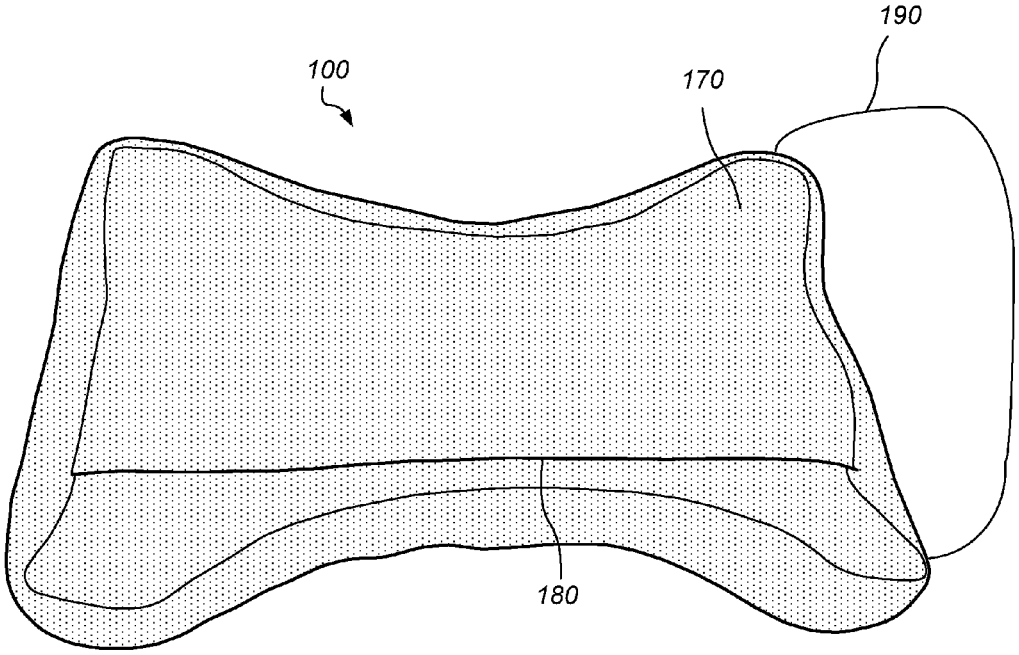
FIG. 5 depicts a perspective view of a covered thoracic back support having a strap.

In another embodiment, depicted in FIG. 5, a coupling device 190 may be a strap or cable that may be coupled to a portion of a seat (e.g., a head rest of a seat). Other types of coupling systems (e.g., a strap that passes through the cover and surrounds the seat) may be used. Straps may be attached from one side of the top portion to another side of the top portion (as shown in FIG. 5), from one side of the lower portion to the other side of the lower portion, from top to bottom, or any diagonal design that will allow the thoracic back support to be attached to a seat with maximal comfort to the user.

In some embodiments, a thoracic back support may be incorporated into a seat (e.g., an vehicle seat). In such embodiments, the thoracic back support is used as the cushioning material for the seat. A standard seat cover, for example, a fabric or leather seat cover, is placed over the thoracic back support. In this manner the thoracic back support is present in the seat without having to externally secure the support to the seat.

Thoracic back support may be provided by coupling thoracic back support 100 to a seat. The position of the thoracic back support may be adjusted such that the thoracic back support is substantially aligned with the user such that the spinous processes of the user are substantially aligned with groove 120 of the thoracic back support. The thoracic back support is also positioned such that the thoracic region of the user is substantially aligned with the upper portion of the thoracic back support. The arcuate tapered portion 135 of thoracic back support 100 is positioned such that the scapula of the user is substantially unsupported by the thoracic back support. In some embodiments, the lower portion of the thoracic back support is substantially aligned with the lumbar region of the user.

During use, a user rests on the thoracic back support compressing the resilient substrate. When the resilient material is compressed, a force is primarily directed into the soft tissue areas adjacent to the spine which allows for the thoracic spine to move into a maximally neutral position. Specifically, the thoracic back support allows the neck to retract into a desirable postural position directly over the shoulders thereby aligning cervical segments on top of one another and reducing potential stress to the cervical nerves. This ideal postural position further allows for more relaxed pectoral muscles which, in turn, reduce the chances of rotator cuff impingement often seen by repetitive stress of the pectoral muscles pulling the shoulders forward and impinging the biceps tendon in the bicipital groove. By virtue of an improved cervicothoracic posture, the lumbosacral joints naturally ease into its lordotic position which also reduces repetitive stress and injury to this area. Thus the thoracic back support promotes a natural lumbosacral curve with minimal postural endurance effort required of the client. Furthermore, an enhanced overall posture control is produced during sitting by encouraging users to center themselves on the spinal pillow. Enhanced control of the muscles, joints and ligaments provides a more comfortable and correct sitting posture that decreases spinal stresses that can cause pain and discomfort.

Advantages of the thoracic back supports described herein include, but are not limited to:

1. Alleviating pressure over the spinous processes via a midline groove;
2. The upper arcuate tapered section provides postural support along the upper scapular spines but not in restriction to their movement;
3. The thoracic back support pushes the thoracic spine into a more neutral position allowing the sternum to push forward and the rib cage to elevate thereby decreasing pressure on the diaphragm and allowing for greater air intake to the lungs. The increased air intake to the lungs allow for improved nutrition to the circulating blood and improved nutrition to the soft tissue;
4. The thoracic back support promotes the spine to be positioned in a neutral position that allows the scapula to relax and retract back, improving overall postural symmetry. A more posturally neutral position also allows the cervical segments to align on top of one another which minimizes the risk of stenosis where the nerves exit the vertebral foramen;
5. Improved cervical alignment decreases the risk of headaches and cervical radiculopathies.
6. The improved neutral position of the thoracic spine, which allows the scapula to retract, also decreases the muscle imbalances between the anterior chest and posterior thoracic muscles which can lead to conditions such as rotator cuff and bicep tendonitis', thoracic outlet and carpal tunnel syndromes;
7. A thoracic back support allows for surfaces that are being worked on in front of the user to be brought closer by virtue of a change in the user's position. When the user is pushed closer to the front surface, they are able to work with their elbows closer to their sides which decreases stress along the neck and shoulders.
8. In vehicles, often times the seat back is built in a concave position to allow for comfort but most individuals, especially women who are smaller than whom the seats have been designed for, are sitting too far away from the steering wheel and, without a telescoping steering wheel, this places the individual in a position in which their arms are at least 45-60 degrees away from the steering wheel. This position causes the thoracic spine to curve forward, the lumbar spine to lose its curve, the scapula to protract which places the majority of the arm weight forward of the chest which pulls the ribcage down, places increased pressure on the diaphragm, thus decreasing breathing inhalation and oxygen intake to the lungs. Decreased oxygen intake to the lungs decreases oxygen nutrition to the soft tissue allowing for a quicker fatigue of the muscle fibers. In this position, the neck is also pulled forward due to its soft tissue attachments to the shoulder, clavicles and shoulder blades. A protracted position of the neck increases muscle imbalances between the anterior and posterior soft tissue around the neck as well as compression around the neurological and circulatory tissues that run on either side of the neck which can contribute to headaches, visual disturbances and a quicker deterioration of the discs and joints of the cervical spine. The thoracic back support helps to alleviate some or all of these conditions.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A thoracic back support for a user sitting in a seat comprising:

a resilient substrate comprising a top surface, wherein a groove is formed along the longitudinal axis of the top surface of the resilient substrate extending into the resilient substrate, wherein the groove comprises a length and a shape that is capable of receiving multiple spinous processes of the user, and wherein the groove has a width and depth such that pressure on the multiple spinous processes of the user is reduced when the user's back is resting against the thoracic back support;

wherein the resilient substrate comprises a top portion, a central portion, and a bottom portion, wherein the top portion has a lateral top surface width greater than the lateral top surface width of the central portion; and wherein the resilient substrate comprises a material having an indentation force deflection of less than about 30, and wherein the groove is formed in the material having an indentation force deflection of less than about 30.

2. The thoracic back support of claim 1, wherein the substrate has an arcuate tapered shape extending from the top portion to the center portion.

3. The thoracic back support of claim 2, wherein the tapered portion of the substrate is shaped such that the scapulas of the user are substantially unsupported by the substrate during use.

4. The thoracic back support of claim 1, wherein the bottom portion has a width greater than the width of the central portion.

5. The thoracic back support of claim 4, wherein the substrate has an arcuate tapered shape extending from the top portion to the center portion, and wherein the substrate has an arcuate tapered shape extending from the bottom portion to the center portion.

6. The thoracic back support of claim 1, wherein the resilient substrate comprises a first resilient material and a second resilient material, wherein the first resilient material has an indentation force deflection that is less than an indentation force deflection of the second resilient material, and wherein the groove is formed in the first resilient material.

7. The thoracic back support of claim 1, further comprising a coupling device coupled to the resilient substrate, wherein the coupling device, during use, couples the resilient substrate to the seat.

8. The thoracic back support of claim 1, further comprising a cover surrounding at least a portion of the substrate.

9. A method of providing thoracic back support to a user sitting in a seat, comprising:

coupling a thoracic back support to a seat, the thoracic back support comprising:

a resilient substrate comprising a top surface, wherein a groove is formed along the longitudinal axis of the top surface of the resilient substrate extending into the resilient substrate, wherein the groove comprises a length and a shape that is capable of receiving multiple spinous processes of the user, and wherein the groove has a width and depth such that pressure on the multiple spinous processes of the user is reduced when the user's back is resting against the thoracic back support;

wherein the resilient substrate comprises a top portion, a central portion, and a bottom portion, wherein the top portion has a lateral top surface width greater than the lateral top surface width of the central portion; and wherein the resilient substrate comprises a material having an indentation force deflection of less than about 30, and wherein the groove is formed in the material having an indentation force deflection of less than about 30;

aligning the thoracic back support with the user such that the spinous processes of the user are substantially aligned with the groove, and positioning the top portion of the thoracic support proximate to the lower cervical-upper thoracic vertebrae of the user.

10. The method of claim 9, wherein the substrate has an arcuate tapered shape extending from the top portion to the center portion.

11. The method of claim 10, wherein the thoracic back support is aligned such that the scapula of the user are substantially unsupported by the thoracic back support.

12. The method of claim 9, wherein the bottom portion is wider than the central portion.

13. The method of claim 12, wherein the substrate has an arcuate tapered shape extending from the top portion to the center portion, and wherein the substrate has an arcuate tapered shape extending from the bottom portion to the center portion.

14. The method of claim 9, wherein the substrate has a longitudinal length such that the top portion provides support for the thoracic region of the user and the bottom portion provides support for the lumbar region of the user.

15. The method of claim 9, wherein the substrate comprises a first resilient material and a second resilient material, wherein the first resilient material has an indentation load deflection that is less than an indentation load deflection of the second resilient material, and wherein the groove is formed in the first resilient material.

16. The method of claim 9, wherein the thoracic back support further comprises a coupling device coupled to the resilient substrate, wherein the coupling device is used to couple the thoracic back support to the seat.

17. The method of claim 9, wherein the thoracic back support further comprises a cover surrounding at least a portion of the substrate.

* * * * *